United States Patent [19]

Sanborn et al.

[11] 4,385,723

[45] May 31, 1983

[54] CONNECTION ASSEMBLY

[75] Inventors: David M. Sanborn, Marietta; Andrew L. Blackshaw, Dunwoody, both of Ga.

[73] E-Tech, Inc., Atlanta, Ga.

[21] Appl. No.: 285,864

[22] Filed: Jul. 22, 1981

[51] Int. Cl.[3] ..... F28F 27/00; F24H 1/00

[52] U.S. Cl. ..... 236/18; 126/351; 62/238.6; 219/331

[58] Field of Search ..... 219/331, 297; 62/238.6; 236/18, 99 J; 122/18; 126/351

[56] References Cited

U.S. PATENT DOCUMENTS

| | | | |
|---|---|---|---|
| 1,551,885 | 9/1925 | Jensen | 236/99 J |
| 3,672,444 | 6/1972 | Lowe | 219/331 X |
| 4,073,285 | 2/1978 | Wendel | 62/238.6 X |

*Primary Examiner*—William E. Wayner

*Attorney, Agent, or Firm*—B. J. Powell

[57] ABSTRACT

A connection assembly for connecting an external heating unit to a heater water tank comprising a mounting assembly connected to a tank opening with a passage opening interiorly of the water tank and connected to the heating unit exteriorly of the water tank, a tube assembly extending through the mounting assembly into the interior of the water tank and thermostatic control means for controlling the operation of the heating unit with a temperature sensing element mounted on the tube assembly within the water tank so that the temperature sensing element is exposed to the temperature of the water in the water tank. The tube assembly may be provided with a tube passage connected to the heating unit exteriorly of the water tank and opening interiorly of the water tank so that water can be withdrawn from the water tank through one of the passages to be supplied to the heating unit and returned from the heating unit to the heater water tank through the other of the passages.

15 Claims, 10 Drawing Figures

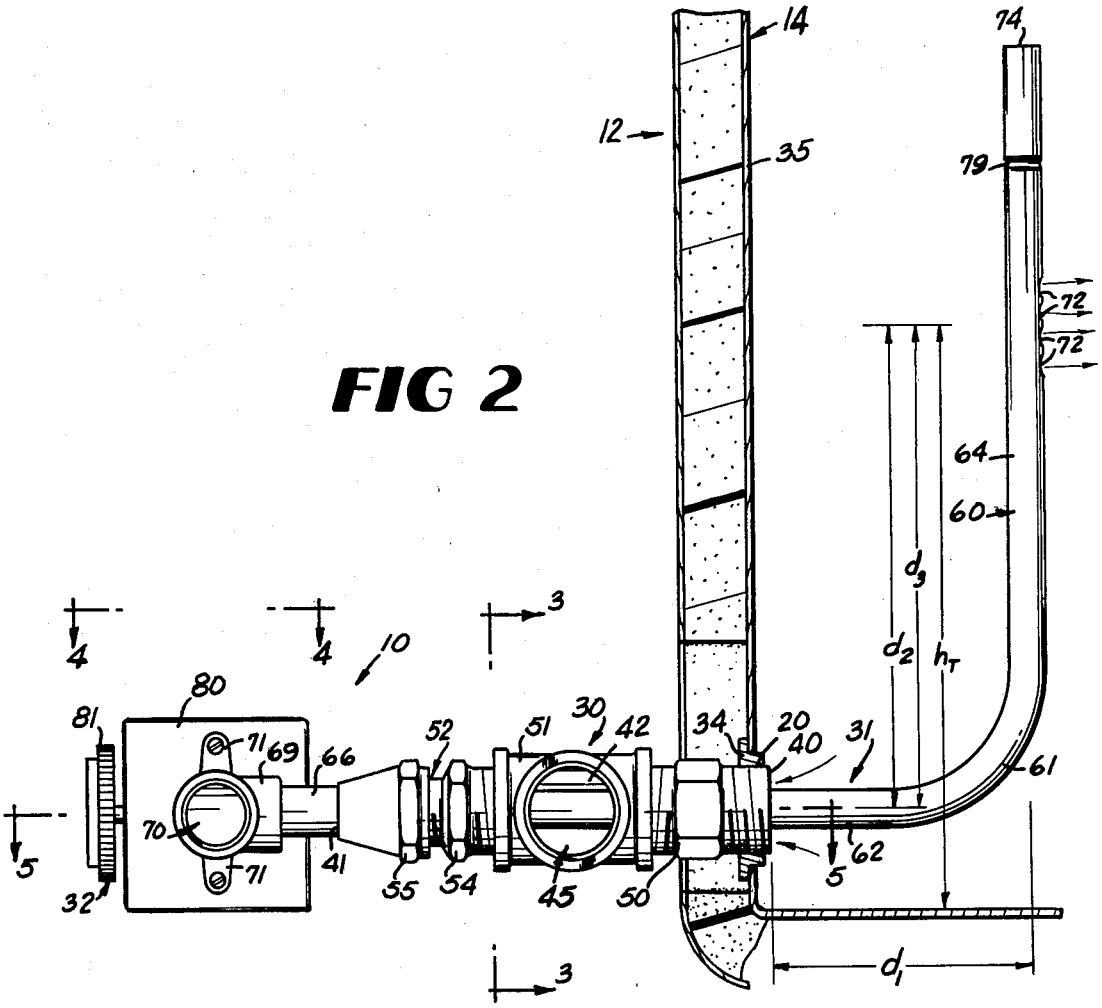
FIG 2
FIG 4
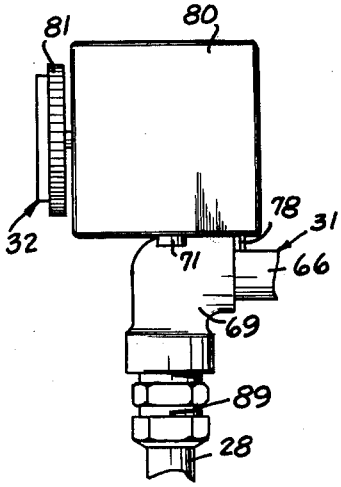
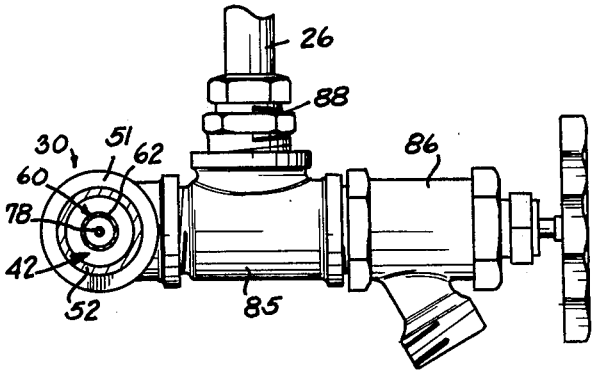
FIG 3

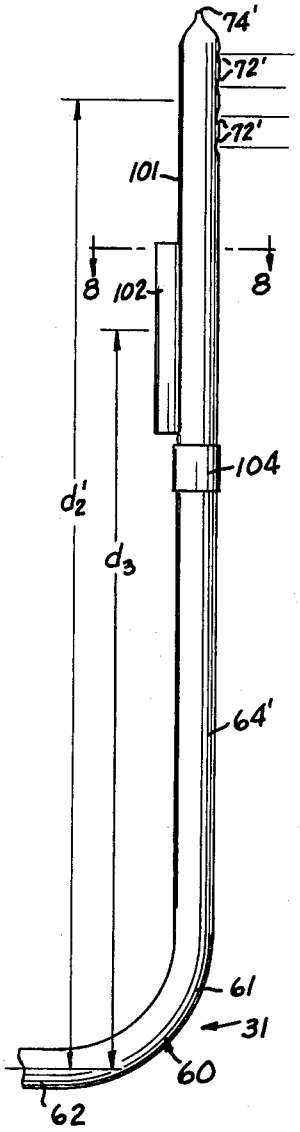
FIG 7
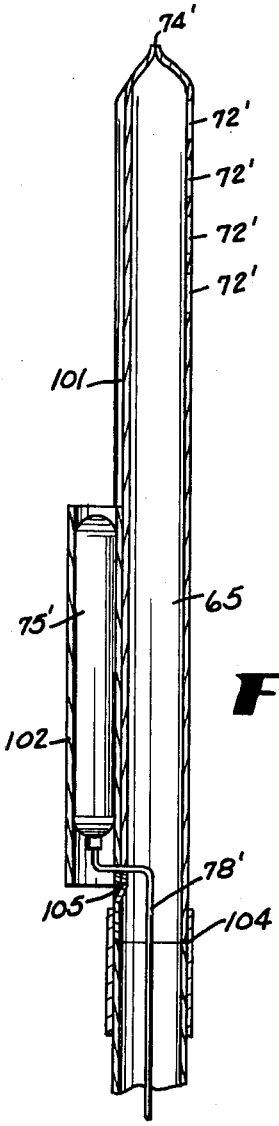
FIG 9
FIG 8
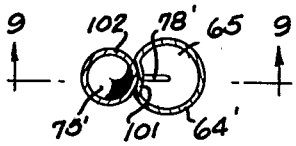
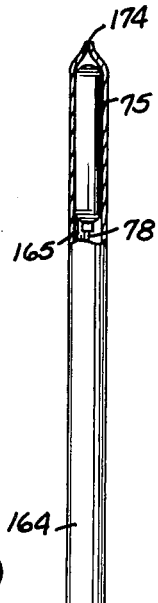
FIG 10
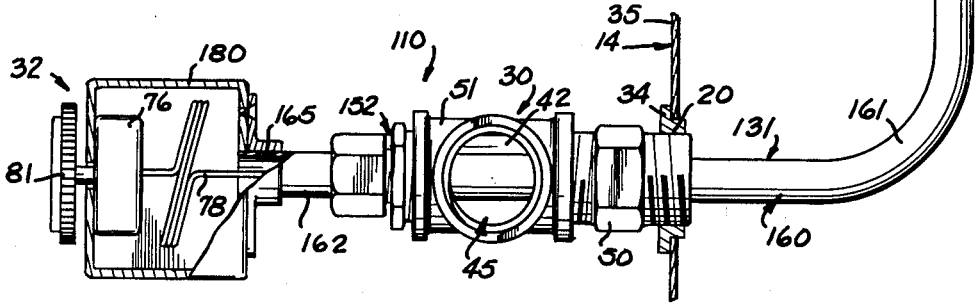

CONNECTION ASSEMBLY

BACKGROUND OF THE INVENTION

Conventional hot water heaters, especially those with electric resistance heating, are being converted so that the water in the water heater is being heated by heat pumps externally of the water heater rather than with electric resistance heating. One of the problems in converting such hot water heaters is the connection of the heat pump to the water heater and the installation of a thermostatically operated controller on the water heater to control the operation of the heat pump. Typically, the heat pump is connected to the hot water heater through available openings in the hot water heater for the withdrawal of the water from the hot water heater to be heated in the heat pump and for return of the heated water to the water heater. The thermostatic controller is typically connected to the outside of the water tank in the heater and under the insulation thereon so as to be responsive to the temperature of the water in the heater water tank. Because the outside of the water heater is typically covered with a metal shell, the location of the thermostatic controller on the outside of the tank is usually limited to those portions of the outside of the tank accessible through this outer shell. On the other hand, the thermostatic controller needs to be located so that it is responsive to the water temperature at some particular height in the tank to achieve reasonable cycles of operation of the heat pump while at the same time providing a reasonable hot water reserve in the heater water tank. This has created problems in the installation of the thermostatic controller since the locating of the controller is dependent on the capability of the installer and since the accessible portions of the outside of the hot water tank may not be located so that the thermostatic controller installed at the accessible portion of the heater water tank will be responsive to the water at the desired height in the tank. Further, installation of the thermostatic controller on the outside of the heater water tank is sometimes precluded by applicable government codes. As a result, the connection of the heat pump to the water heater has been a time consuming operation.

SUMMARY OF THE INVENTION

This invention provides a connection assembly for connecting a heat pump to a conventional hot water heater so that the connection operation is greatly simplified while the proper operation of the heat pump is assured. The connection assembly incorporates a thermostatic controller for controlling the operation of the heat pump which is placed in the desired operative communication with the water in the water heater as an incidence to the installation of the connection assembly on the water heater thus reducing the number of connections which must be made between the heat pump and water heater. One embodiment of the connection assembly totally connects the heat pump to the water heater using a single opening into the heater water tank to minimize the number of connections between the heat pump and water heater.

The connection assembly is designed for connection to the water tank of the water heater through the drain opening adjacent the bottom of the water tank. The connection assembly defines a passage therein which communicates with the water in the heater water tank when the connection assembly is connected to the drain opening. The connection assembly provides for the connection of the passage to the heat pump externally of the heater water tank so that water is withdrawn from the water tank through the connection assembly and supplied to the heat pump for heating. The connection assembly is also provided with a positioning tube which extends through the passage into the heater water tank. The positioning tube mounts the temperature sensing element of a thermostatic controller so that, as an incidence to the installation of the connection assembly in the drain opening to the heater water tank, the sensing element of the thermostatic controller is located inside the heater water tank to expose the temperature sensing element to the water in the tank. The positioning tube is bent so that it extends upwardly in the tank when the connection assembly is installed. Because the drain opening is located closely adjacent the bottom of the heater water tank, locating the temperature responsive element at a particular height above the drain opening inherently locates the height of the temperature responsive element in the heater water tank. This allows the height at which the temperature responsive element of the thermostatic controller will be located within the heater water tank to be preselected during manufacture of the connection assembly rather than having to wait until connection of the heat pump to the water heater is being made to determine and locate the temperature sensing element at the desired height.

The heated water from the heat pump may be returned to the heater water tank through the connection assembly by connecting the return water outlet on the heat pump to the positioning tube mounting the temperature sensing element of the thermostatic controller. This connection is made externally of the heater water tank. When the heated water is to be discharged into the heater water tank below the height of the temperature sensing element in the tank, the temperature sensing element is installed inside the positioning tube at the inboard end of the tube so that the passage through the tube is closed at its inboard end. Discharge ports are provided through the positioning tube below the temperature sensing element for the discharge of the heated water into the heater water tank. When the heated water is to be discharged into the heater water tank above the height of the temperature sensing element, the temperature sensing element is mounted on the outside of the positioning tube so that the heated water can flow through the tube passage past the temperature sensing element before it is discharged into the heater water tank.

The connection assembly of the invention includes a mounting assembly which is connected to the drain opening in the heater water tank. The mounting assembly has a passage therein with one opening inside the water tank and another opening outside the water tank when the connection assembly is installed. A tube assembly is mounted in the mounting assembly and extends through the mounting assembly so that its inboard end is inside the tank and its outboard end is outside the mounting assembly and the tank. The tube assembly mounts the temperature sensing element of a thermostatic controller to locate the temperature sensing element inside the tank when the connection assembly is installed so that the temperature sensing element is exposed to the water in the tank. A connection extends through the tube assembly to a position exteriorly of the heater water tank to permit connection of the thermostatic controller with the heat pump exteriorly of the tank. The heat pump is connected to the passage opening in the mounting assembly exteriorly of the heater water tank so that water is withdrawn from the heater water tank through the passage in the mounting assembly for heating in the heat pump.

In one embodiment of the connection assembly, the heated water from the heat pump is returned to the heater water tank through another opening in the water tank. In that embodiment of the connection assembly, the inboard end of the passage through the tube assembly is closed to isolate the passage from the water in the heater water tank. The temperature sensing element is located in the tube passage at its inboard end to expose the temperature sensing element to the temperature of the water in the heater water tank while the connection extends through the tube passage exteriorly of the heater water tank for connection of the thermostatic controller to the heat pump exteriorly of the tank.

In another embodiment of the connection assembly, the heated water from the heat pump is returned to the heater water tank through the passage in the tube assembly. The heated water return outlet from the heat pump is connected to the passage in the tube assembly exteriorly of the heater water tank and the mounting assembly. In one version of this embodiment of the connection assembly, the temperature sensing element is located in the inboard end of the passage through the tube assembly so that the heated water returning through the tube assembly passage is prevented from flowing past the temperature sensing element. Discharge openings are provided through the tube assembly between the temperature sensing element and the mounting assembly so that the heated water is discharged from the tube assembly passage into the heater water tank before it reaches the temperature sensing element. In another version of this embodiment of the connection assembly, the temperature sensing element is positioned on the outside of the tube assembly between the inboard end of the tube assembly and the mounting assembly. The heated water is returned through the tube assembly passage past the temperature sensing element and discharged into the heater water tank through discharge openings above the temperature sensing element. The discharge openings in the tube assembly direct the water returning to the tank away from the temperature sensing element on the thermostatic controller to minimize the affect of the heated water on the temperature sensed by the sensing element.

These and other features and advantages of the invention will become more apparent upon consideration of the following description and accompanying drawings wherein like characters of reference designate corresponding parts throughout the several views and in which:

BRIEF DESCRIPTION OF THE DRAWINGS

FIG. 2 is an enlarged view of the connection assembly;

FIG. 3 is an enlarged cross-sectional view taken generally along line 3—3 in FIG. 2 showing the connection of the mounting assembly to the heating unit;

FIG. 4 is an enlarged cross-sectional view taken generally along line 4—4 in FIG. 2 showing the connection of the tube assembly to the heating unit;

FIG. 7 is a view illustrating a modification of the inboard end of the tube assembly;

FIG. 8 is an enlarged cross-sectional view taken along line 8—8 in FIG. 7;

FIG. 9 is a cross-sectional view taken along line 9—9 in FIG. 8; and FIG. 10 is a view illustrating a second embodiment of the connection assembly.

These figures and the following detailed description disclose specific embodiments of the invention; however, it is to be understood that the inventive concept is not limited thereto since it can be incorporated in other forms.

DETAILED DESCRIPTION OF ILLUSTRATIVE EMBODIMENTS

Figure 1:
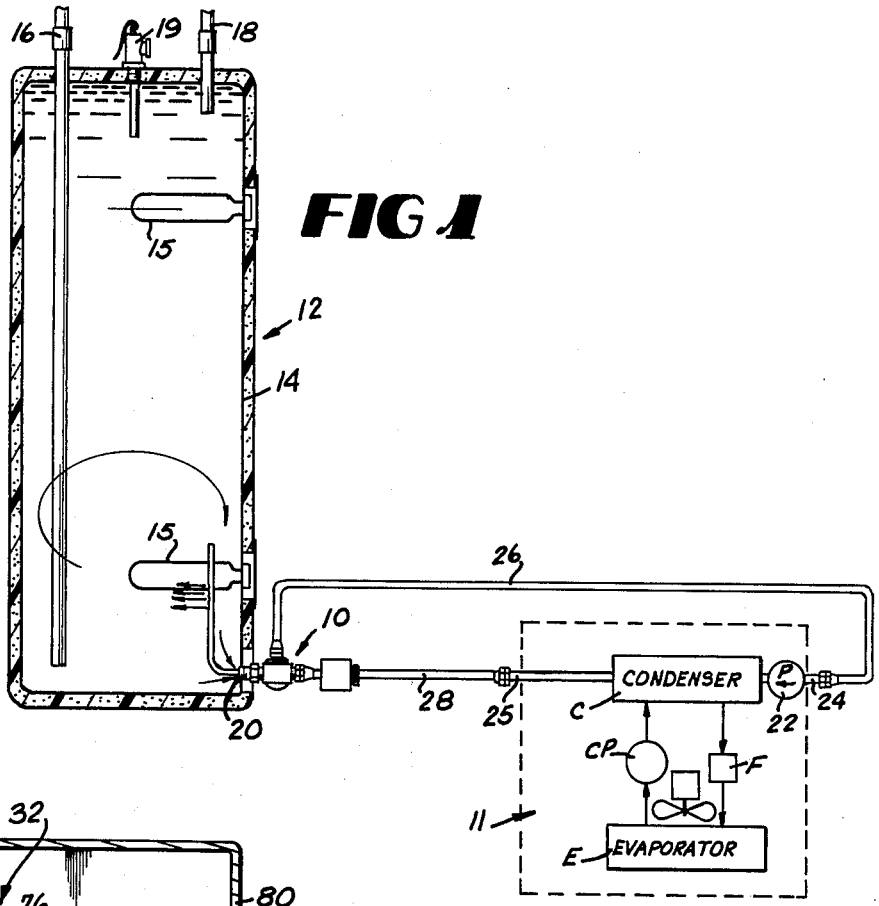
FIG. 1 is a schematic view illustrating the invention in use.
Figure 6:
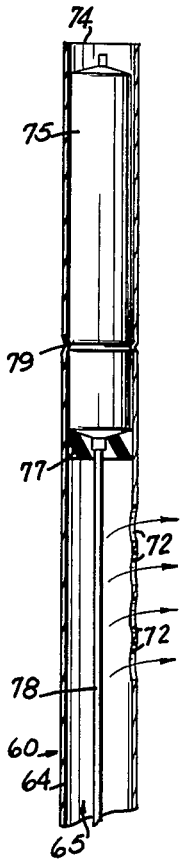
FIG. 6 is an enlarged longitudinal cross-sectional view of the inboard end of the tube assembly.

Referring to FIG. 1 of the drawings, the connector assembly 10 of the invention is illustrated connecting a heat pump heating unit 11 to a conventional hot water heater 12. The hot water heater 12 has an upright water tank 14 equipped with electrical resistance heating elements 15. Since the heating unit 11 is used to heat the hot water in tank 14, the heating elements 15 are usually disabled. Cold water is supplid to the tank 14 through a supply pipe 16 which empties adjacent the bottom of the tank and hot water is withdrawn from the upper end of tank 14 through hot water pipe 18. A pressure and temperature relief valve 19 is provided at the upper end of the tank 14 to prevent damage to the tank in the event of overheating. A drain opening 20 is provided in tank 14 adjacent its lower end to permit the tank to be drained for servicing. The connector assembly 10 is illustrated connecting the heating unit 11 to tank 14 through the drain opening 20; however, it is to be understood that other openings in the water tank may be used. Preferably, the drain opening is used since it facilitates the withdrawal of the coldest water from the tank and since the normal connections to the tank do not have to be disturbed to make the connection.

The heating unit 11 illustrated in FIG. 1 includes a condenser heat exchanger C, an evaporator heat exchanger E, a compressor CP and a liquid flow control valve F operating in conventional vapor compression refrigeration cycle. A circulation pump 22 pumps water from the tank 14 through the condenser heat exchanger C where heat is transferred to the water from the heat pump refrigerant to heat the water. The evaporator heat exchanger E is illustrated as a refrigerant to air type although any type of exchanger may be used.

The connector assembly 10 serves to connect both the intake pipe 24 and the outlet pipe 25 on the heating unit 11 to the water tank 14 through the drain opening 20. As will become more apparent, water is withdrawn through connector assembly 10 from one position in tank 14 and returned to tank 14 at another position. Also, as will become more apparent, a withdrawal pipe 26 removably connects the connector assembly 10 with the intake pipe 24 on heating unit 11 while a return pipe 28 removably connects the connector assembly 10 with the outlet pipe 25 on the heating unit 11. Thus, it will be seen that the circulation pump 22 withdraws water from tank 14 via connector assembly 10 and withdrawal pipe 26, circulates the water through the condenser heat exchanger C where it is heated, and then returns the heated water to tank 14 via return pipe 28 and connector assembly 10.

As best seen in FIGS. 2–6, the connector assembly 10 includes a mounting assembly 30, a return tube assembly 31, and a thermostatic controller 32. The water is typically withdrawn from the water tank 14 through the mounting assembly 30 and returned to the water tank through the return tube assembly 31. The thermostatic controller 32 is mounted on the return tube assembly 31 and responsive to the temperature of the water in tank 14 to control the operation of the heat pump.

The drain opening 20 is defined through an internally threaded plug 34 mounted in the tank wall 35 adjacent the lower end of tank 14. The inboard end 40 of mounting assembly 30 threadedly engages the plug 34 so that the outboard end 41 of assembly 30 projects exteriorly of tank 14. The mounting assembly 30 defines a withdrawal passage 42 therein with an inlet opening 44 thereto through the inboard end of assembly 30 and an outlet opening 45 therefrom intermediate the ends of assembly 30. Thus, when the mounting assembly 30 is screwed into the plug 34, the inlet opening 44 to passage 42 will be located inside water tank 14 at the drain opening 20 while the outlet opening from passage 42 will be located exteriorly of tank 14.

The mounting assembly 30 is built up from a plurality of components; however, it is to be understood that different components may be used and that the components may be integrally combined without departing from the scope of the invention. As best seen in FIGS. 2–5, the mounting assembly 30 includes a nipple 50, one end of which is screwed into the plug 34 and thus forms the inboard end of the assembly 30. The opposite end of the nipple 50 is screwed into one of the opposed openings in a tee 51. The side opening oriented at right angles to the opposed openings in tee 51 serves as the outlet opening 45 of assembly 30. A fitted 52 is screwed into the other opposed opening in the tee 51 and serves to mount the return tube assembly 31 as will become more apparent. Thus, it will be seen that the nipple 50 and tee 51 define the withdrawal passage 42 therein horizontally oriented and extending longitudinally of the assembly 30 with the outlet opening therefrom oriented at right angles to the passage 42.

The fitting 52 has a male portion 54 threaded on one end to be screwed into the tee 51 and threaded on the opposite end to receive a female portion 55 to form a flare joint. That end of the male portion 54 receiving the female portion defines a reduced diameter passage 56 therethrough coaxial with the passage 42 while the female portion 55 defines a slightly larger passage 58 therethrough coaxial with the passage 56. It is likewise understood that fitting may be a compression type fitting without departing from the scope of the invention.

The return tube assembly 31 includes an elongated return tube 60 with a central bend section 61, a straight outboard section 62 with one end of the bend section 61, and a straight inboard section 64 integral with the opposite end of the bend section 61. The bend section 61 orients the straight sections 62 and 64 so that they are at right angles with each other. The return tube 60 defines a passage 65 therethrough and has an outside diameter smaller than the diameter of the withdrawal passage 42 in the mounting assembly 30. While these diameters may be varied, the diameter of the withdrawal passage is illustrated at about 0.75 inch and the outside diameter of the return tube 60 is illustrated at about 0.50 inch. The diameter of the passage 56 through the male portion 54 of fitting 52 is sufficient to slidably receive the return tube 60 therethrough as will become more apparent.

The outboard section 62 of the return tube 60 has a length longer than that of the mounting assembly 30 and extends through the passage 56 in fitting 52 and withdrawal passage 42 in assembly 30 so that the outboard end of tube 60 is located exteriorly of the mounting assembly 30 and tank 14 while the bend section 61 and inboard section 64 are spaced from the inboard end of the assembly 30 and within the interior of tank 14. To connect the return tube 60 to the fitting 52, a short mounting tube 66 is fitted over the outboard end of the outboard section 62 so that the outboard end of tube 66 is flush with the outboard end of section 62. Tube 66 extends through the passage 58 in the female portion of fitting 52 and is flared at its inboard end so that the flared end of tube 66 will be clamped between the male and female portions 54 and 55 of fitting 52 when the female portion 55 is tightened. It will also be appreciated that, when the female portion 55 is loosened, the mounting tube 66 can be rotated with respect to the mounting assembly 30. Alternatively, a compression type fitting may be used to connect the tube 60 to the mounting assembly 30 instead of fitting 52 and tube 66.

The outside diameter of return tube 60 is slightly smaller than the inside diameter of the mounting tube 66. To attach tube 60 to tube 66, the outboard end of the tube 60 is expanded as indicated at 68 out to the inside diameter of tube 66. The expanded portion 68 of tube 60 is then brazed to tube 66 to connect the tubes 60 and 66 and also seal them. Thus, tube 60 is fixedly attached to tube 66 so that tube 60 is fixedly mounted on the mounting assembly 30 when the female portion 55 of fitting 52 is tightened. Tightening the female portion 55 also serves to seal the return tube assembly 31 with respect to fitting 52 so that water within passage 42 cannot flow out through fitting 52 around the return tube assembly 31. Thus, it will be seen that the outboard portion of the return tube 60 extends coaxially through the withdrawal passage 42 so that water can pass through passage 42 around the return tube 60.

The outboard ends of the return tube 60 and the mounting tube 66 are attached to one of the openings in an elbow 69 by brazing. The other opening 70 in elbow 69 serves as the inlet to the passage 65 through the return tube 60. The elbow 69 is also provided with a pair of mounting tabs 71 as will become more apparent.

The return tube assembly 31 is oriented so that the inboard section 64 of the return tube 60 extends generally vertically upwardly in tank 14 from the bend section 61 and is spaced from the inboard end 40 the distance $d_1$ illustrated at about 3.5 inches. A plurality of discharge holes 72 are defined through the wall of return tube 60. The discharge holes 72 are spaced below the inboard end 74 of the return tube 60 but above the level of the inlet opening 44 to the withdrawal passage 42 a means distance $d_2$ illustrated at about 7 inches as will become more apparent. The discharge holes 72 are oriented so that water flowing into the tank 14 through passage 65 and holes 72 will be directed laterally outwardly from the return tube 60 in a direction away from the inlet opening 44 to withdrawal passage 42.

The thermostatic controller 32 illustrated has a temperature sensing element 75 shown as a thermostat bulb connected to a thermostatic switch mechanism 76 through a capillary tube 78. The sensing element 75 has a temperature responsive fluid in it whose pressure changes in response to temperature with this pressure change communicated to the switch mechansim 76 via capillary tube 78 to operate the switch mechanism 76 in response to the temperature at the sensing element 75. The temperature sensing element 75 is mounting in the passage 65 through the return tube 60 between the discharge holes 72 and the inboard end 74 of tube 60 at a mean distance $d_3$ above the inlet opening 44 to the withdrawal passage 42. The side wall of tube 60 is crimped around the sensing element 75 as indicated at 79 in FIGS. 2 and 6 to lock the sensing element within tube 60 and to prevent the water flowing through passage 65 from flowing past the sensing element 75. A seal 77 may be provided at that end of the element 75 facing holes 72 to further isolate the heated water from element 75. Thus, the water flowing through passage 65 is forced to flow out of tube 60 into tank 14 through the discharge holes 72. The capillary tube 78 extends from the sensing element 75 along the passage 65 in tube 60 through the mounting assembly 30 and then extends out through the side walls of return tube 60 and the mounting tube 66 exteriorly of the mounting assembly 30. The capillary tube 78 is brazed to tubes 60 and 66 where it passes through the side walls thereof to seal the tube 78 to the side walls of tubes 60 and 66.

Figure 5:
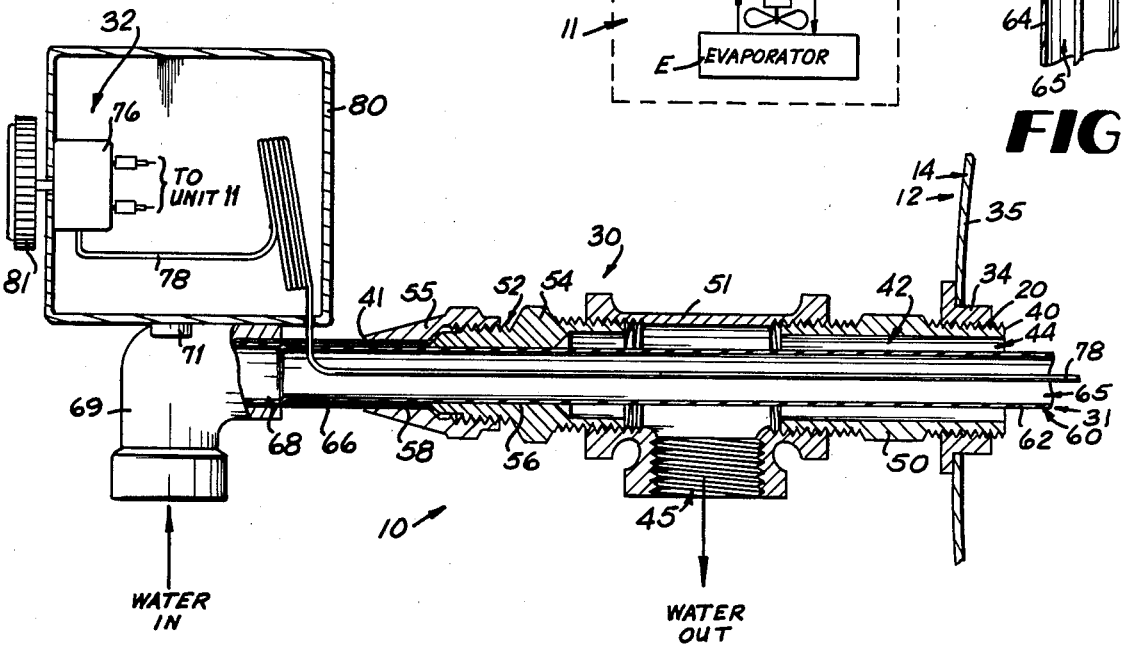
FIG. 5 is an enlarged longitudinal cross-sectional view taken generally along line 5—5 in FIG. 2.

The switch mechanism 76 is mounted in an appropriate case 80 mounted on the tabs 71 on the elbow 69 and has an adjustment control 81 located exteriorly of case 80 so that the temperature at which the switch mechanism 76 is transferred can be adjusted in known manner. The capillary tube 78 extends into the case 80 through an appropriate opening therein as seen in FIG. 5 and is connected to the switch mechanism 76 to operate it. Any excess length of tube 78 may be coiled in case 80 as seen in FIG. 5. The switch mechanism 76 is appropriately connected to the heating unit 11 to start its operation when the temperature in the water in tank 14 around the temperature sensing element 75 falls below a prescribed lower temperature and stops its operation when the temperature of the water around the element 75 has been raised to a prescribed higher temperature. Typically, the lower temperature at which operation of the heating units is initiated is about 10°–20° F. below the higher temperature at which operation of the heating unit is stopped.

By mounting the temperature sensing element 75 at the inboard end of the return tube 60, the element 75 is exposed to the temperature of the water in the tank 14 around the inboard end of tube 60 since the temperature is transmitted to element 75 through the side wall of tube 60. At the same time, the temperature sensing element 75 is only minimally exposed to the heated water being returned to tank 14 through return tube 60 since that water is forced out of tube 60 through discharge holes 72. Since holes 72 direct the water laterally outwardly of return tube 60, the heated return water is allowed to mix with the water in tank 14 before any of this heated return water is significantly exposed to the sensing element 75. The return tube 60 around the temperature sensing element 75 serves to protect the element against damage, especially while the connection assembly 10 is being installed in the tank 14.

It is also to be understood that different techniques may be used for mounting the temperature sensing element 75 on tube 60. Likewise, it will be understood that the temperature sensing element 75 may project beyond the inboard end 74 of tube 60. Other types of thermostatic controller may be used in lieu of the controller 32 illustrated such as thermister, thermocouple or bi-metallic types. Regardless of the type, the temperature sensing element would be located at the inboard end of the return tube 60 so as to be responsive to the temperature of the water in the water tank 14. Where temperature sensing element and switch mechanism are combined, the combined unit would be mounted at the inboard end of the tube 60 and the wires for connection to the heating unit 11 would pass along the passage 65 in tube 60 and exit tube 60 exteriorly of tank 14 similarly to the capillary tube 78 for connection to the heating unit.

Fig. 3 shows the connection of the tee 51 in the mounting assembly 30 to the withdrawal pipe 26 to connect the outlet opening 45 from passage 42 in assembly 30 to the intake pipe 24 on heating unit 11. A street tee 85 is screwed into the side opening in the tee 51 and a drain valve 86 is screwed into the opposite end of the street tee 85. The withdrawal pipe 26 is connected to the side opening in the street tee 85 with an appropriate fitting 88 shown as a compression type fitting although other types of fittings may be used. When a hose adapted to be screwed onto the drain valve 86 is used to connect the connection assembly 30 to the heating unit 11, the street tee 85 can be eliminated and drain valve 86 screwed directly into the side opening in the tee 51. It is likewise to be understood that different fittings or arrangements thereof may be used to connect the connection assembly 30 to withdrawal pipe 26.

FIG. 4 shows the connection of the elbow 69 in the return tube assembly 31 to the return pipe 28 to connect the inlet opening 70 to the return passage 65 in assembly 31 to the outlet pipe 25 on the heating unit 11. This connection is made through an appropriate fitting 89 also shown as a compression type fitting that is screwed into elbow 69 although other types of fittings may be used. When a hose adapted to be screwed onto a drain valve is used to connect the connection assembly 30 to the heating unit 11, a drain valve such as valve 86 would be substituted for fitting 89.

The connection assembly 10 is installed on tank 14 before being connected to the pipes 26 and 28 and after the original drain valve at the drain opening 20 is removed. The female portion 55 on fitting 52 is loosened sufficiently for the return tube assembly 31 to rotate with respect to the mounting assembly 30. The inboard end of the return tube 60 is inserted through the drain opening first and the inboard end 40 of the mounting assembly 30 is screwed into the drain opening 20 while the return tube assembly 31 is held against rotation. The position of the case 80 can be used as a visual indication of the orientation of the inboard section 62 of the return tube 60 in tank 14. After the mounting assembly 30 is screwed into the opening 20, the female portion 55 on fitting 52 is tightened while the return tube assembly 31 is oriented so that the inboard section 64 extends generally vertically upwardly in the water tank 14. This serves to both fix the position of the return tube assembly 31 with respect to the mounting assembly 30 and to form a water tight seal around the return tube assembly 31 where it passes out of the mounting assembly 30.

The withdrawal pipe 26 is then connected to the outlet opening 45 from passage 42 in the mounting assembly 30 and the return pipe 28 is connected to the inlet opening 70 in elbow 69 to the return passage 65 through the return tube assembly 31. The thermostatic controller 32 is appropriately connected to the heating unit 11 to control same.

The drain opening 20 is typically located closely adjacent the bottom of the heater water tank 14. This results in the drain opening 20 being spaced above the bottom of the water tank at about the same distance for different types and sizes of water heaters. This allows the drain opening 20 to be used as the reference point to locate the height of the temperature sensing element 75 above the bottom of the tank. Because the drain opening 20 is used as a reference point, the height $h_T$ of the temperature sensing element 75 above the bottom of the water tank 14 can be preselected as the connection assembly 10 is being manufactured by selecting the distance $d_3$ that the temperature sensing element 75 is located above the inlet opening 44 to the passage 42 through mounting assembly 30. The distance $d_3$ is selected great enough so a sufficient volume of water will be heated during each cycle of operation of the heat pump 11 to prevent the heat pump 11 from being cycled so frequently that the heat pump 11 is damaged. On the other hand, the distance $d_3$ is selected small enough so that a large enough heated water reserve is maintained in the water tank 14 to give reasonable usage. Typically, satisfactory operation has been achieved when the distance $d_3$ is selected to cause the cycle of operation of the heat pump 11 to be started after three-five gallons of hot water have been consumed.

When the temperature of the water in the water tank 14 at the level of the temperature sensing element 75 drops below the set point of the thermostatic controller 32, the element 75 causes the switch mechanism 76 to transfer and start operation of the heating unit 11. Pump 22 withdraws water from the bottom of water tank 14 at the drain opening 20 through the withdrawal passage 42 in mounting assembly 30 and forces it through the condenser heat exchanger C where the water is heated. The heated water is returned via pipe 28 to the passage 65 in the return tube assembly 31. This heated water flows through passage 65 and is discharged into the water tank 14 through the discharge holes 72 under the temperature sensing element 75. The holes 72 direct the heated water laterally outward of the inboard end of the return tube 60 where it rises in the tank 14 while causing the colder water in tank 14 to move toward the bottom of the tank and the discharge opening 20. This establishes a circulation in that portion of the water in the tank 14 having a temperature no greater than that of the returning heated water from the heating unit 11. This circulation is facilitated by discharging all of the heated water from the return tube 60 in one direction as illustrated in FIG. 2. Also, by discharging the heated water laterally outward of the return tube 60, the heated water is allowed to mix with the other water in the tank before being significantly exposed to the temperature sensing element 75.

Typically, the cold water supplied to the tank 14 as hot water is consumed is on the order of 40°–80° F. and remains stratified in the bottom of the tank since the hot water in the tank is usually at about 120°–140° F. The thermostatic controller 32 is usually adjusted so that controller 32 stops operation of heating unit 11 when the temperature of the water in the heater water tank at the level of the temperature sensing element 75 reaches a selected cut-off temperature in the 120°–140° F. range. The controller 32 initiates operation of the heating unit 11 when the temperature of the water at the level of the temperature sensing element 75 drops 10°–20° F. below the selected cut-off temperature.

The heating capacity of the heat pump 11 is such that the water is heated about 5°–15° F. each time it is pumped through the condenser heat exchanger C. Because of this, the cold water will be circulated several times through the condenser heat exchanger C before it has been gradually heated up to the desired tank temperature. Thus, the temperature of the heated water being returned to the water tank 14 through the return tube 60 does not reach the cut-off temperature of the thermostatic controller 32 until the coldest water in tank 14 has been raised to within 5°–15° F. of the controller cut-off temperature. This further minimizes the return water temperature affecting the temperature of the water exposed to the temperature sensing element 75 so as to cause the thermostatic controller 32 to prematurely stop operation of the heat pump 11 before the tank temperature has reached the cut-off temperature.

It is sometimes desirable to discharge the heated water being returned to the heater water tank 14 at a position higher than the temperature sensing element 75. FIGS. 7–9 show a modification of the return tube assembly 31 which permits such discharge. This modification has been made on the inboard section of the return tube 60 and is designated 64'. The inboard section 64' is longer than the inboard section 64 and has a longitudinally extending concave section 101 formed in a portion of the tube wall that extends a prescribed distance along the inboard section 64' from the inboard end 74' of section 64'. An auxiliary mounting tube 102 is mounted in the concave section 101 outside of the inboard section 64' and serves to mount the temperature sensing element 75' of the thermostatic controller therein. Typically, the inboard end 74' of the inboard section 64' is closed and a plurality of discharge ports 72' are provided through the side wall of the inboard section 64' adjacent the inboard end 74' so that the heated water being returned to the heater water tank through the passage 65 in the inboard section 64' will be discharged through holes 72'.

The mounting tube 102 is located along the inboard section 64' of tube 60 so that the temperature sensing element 75' mounted therein is located the same mean distance $d_3$ from the center of the outboard section 62 of tube 60 as that described for the first version of mounting assembly 10 so that it will be located the same height above the bottom of the heater water tank as the temperature sensing element 75 is located. The discharge openings 72' are located the distance $d_2'$ above the outboard section 62 of tube 60 which is greater than the distance $d_3$. Thus, the heated water is discharged into the heater water tank above the temperature sensing element 75' rather than below same as described in the first version. This allows the distance $d_3$ to be selected for optimum cycling of the heat pump 11 while the distance $d_2$ of point of discharge of the heated water returned to the tank can be selected for the desired water circulation.

The mounting tube 102 is brazed or soldered to the inboard section 64' to mount it. The length of the mounting tube 101 is just sufficient for the temperature sensing element 75' to be received therein. Opposite ends of the mounting tube 101 may be left open as illustrated to permit free access of the water in the heater water tank to the element 75'. Alternatively, opposite ends of tube 102 may be closed with the temperature sensing element 75' having enough contact with the tube 101 to expose the element 75' to the temperature of the water in the heater water tank around tube 102. The tube 102 may be filled with a heat conductive material around element 75' to provide this same effect.

The outside diameters of the inboard section 64' and the mounting tube 102 are selected so that their combined largest dimension is less than the diameter of the drain opening 20 so that the inboard section 64' and the mounting tube 102 will pass through opening 20 as the connection assembly 10 is being installed. Because the mounting tube 101 is spaced from the mounting assembly 30, it does not interfere with the installation of the mounting assembly 30 nor does it affect the flow of the water through the passage 42 in mounting assembly 30.

The capillary tube 78' connecting the temperature sensing element 75' with the rest of the thermostatic controller passes through the side wall of the mounting tube 101 and the side wall of the inboard section 64' of tube 60 into the passage 65 through tube 60. Capillary tube 78' then extends along passage 65 in the same manner as tube 78 in the first version of connection assembly 10. To facilitate the installation of the temperature sensing element 75' without having to disconnect the capillary tube 78', a joint 104 may be provided in the inboard section 64' adjacent the position where the capillary tube 78' passes through the side wall of the inboard section 64'. This allows the section 64' to be slotted at the joint 104 to receive the capillary tube 78' and the slot is sealed by brazing or soldering as indicated at 105 in FIG. 9 after the capillary tube 78' and temperature sensing element 75' are installed and as joint 104 is sealed.

The connection assembly 10 with the modified inboard section 64' on return tube 60 is installed in the same manner as that described for the first version of connection assembly 10. The heated water returned to the heater water tank will flow past the temperature sensing element 75' without materially affecting its temperature responsiveness to the water in the heater water tank around the mounting tube 101.

In some instances, it is desirable to return the heated water to the heater water tank at a position not readily reached through the drain opening 20. One such instance is where the heated water is returned to the top of the heater water tank. Returning the heated water to the top of the heater water tank is usually more feasible through an appropriate connection at the pressure and temperature relief valve 19 or the hot water outlet pipe 18.

FIG. 10 shows a second embodiment of the connection assembly designated 110 for use when the heated water is not returned to the heater water tank 14 through the connection assembly 110. Those components of the connection assembly 110 which are the same as connection assembly 10 have the same reference numbers applied thereto.

The mounting assembly 30 is the same as that for assembly 10 except that a compression type fitting 152 has been used in lieu of fitting 52. It is to be understood that different types of fittings may be used. The withdrawal passage 42 is connected to the inlet on the heating unit 11 in the same manner as that for connection assembly 10.

The tube assembly 131 includes elongated positioning tube 160 with a central bend section 161, a straight outboard section 162 and a straight inboard section 164 corresponding to that of tube 60. Positioning tube 160 has a passage 165 therein which is closed at the inboard end 174 of tube 160. The outboard section 162 of tube 160 extends through passage 42 in mounting assembly 30 and out through fitting 152 exteriorly of assembly 30 so that when fitting 152 is tightened, it will clamp the tube 160 in place and seal the tube 160 with respect to the mounting assembly 30 so that water cannot escape therearound. This locates the inboard section 164 within the heater water tank 14 as described for assembly 10.

The housing 180 for the thermostatic controller 32 is mounted on the outboard end of the tube 160 so that the passage 165 in tube 160 opens into the housing 180. Housing 180 mounts the switch mechanism 76 therein as described for housing 80 for assembly 10. The temperature sensing element 75 is positioned in passage 165 adjacent the closed inboard end 174 thereof and the capillary tube 78 therefrom simply extends along passage 165 and out the outboard end of tube 160 to the switch mechanism 76. Because the inboard end 174 of tube 160 is closed and there are no discharge openings therein as with tube 60 in connection assembly 10, the water in the heater water tank 14 does not enter the passage 165 in tube 160. The temperature sensing element 75, however, is exposed to the temperature of the water in the heater water tank 14 through the side wall of tube 160. A heat conducting material may be added between the side wall of tube 160 and the temperature sensing element 75 if desired.

The connection assembly 110 is installed similarly to connection assembly 10 so that the inboard section 164 on the positioning tube 160 extends vertically in the heater water tank 14 to locate the temperature sensing element 75 above the drain opening 20 in the heater water tank. This locates the temperature sensing element 75 at the desired prescribed height above the bottom of the water tank for the proper operation of the heating unit. The water is withdrawn through passage 42 in mounting assembly 30 and is returned to the tank at another location.

What is claimed as invention is:

1. A connection assembly for connecting an external heating unit to a heater water tank through a tank opening in the water tank so that water can be withdrawn from the water tank, circulated through the heating unit for heating, and then returned to the water tank; said connection assembly comprising:

a mounting assembly connected to the tank opening and defining a first passage therein, said first passage having a first opening thereto interiorly of the water tank and a second opening thereto exteriorly of the water tank connected to the heating unit so that water can flow through said passage between the heater water tank and the heating unit;

a tube assembly mounted in said mounting assembly and extending through said first passage into the interior of the water tank said tube assembly defining a tube passage therein closed at the end of said tube assembly in the heater water tank and having an opening thereto exteriorly of the heater water tank and said mounting assembly so that water from the heater water tank is prevented from entering said tube passage; and thermostatic control means for controlling the operation of the heating unit, said thermostatic control means including a temperature sensing element mounted in said tube passage adjacent the closed end thereof within the water tank so that said temperature sensing element is exposed to the temperature of the water in the heater water tank through said tube assembly, said thermostatic control means responsive to the temperature of the water in the heater water tank at said temperature sensing element being below a first prescribed temperature to operate the heating unit until the temperature of the water in the heater water tank at said temperature sensing element has been raised to a second prescribed temperature and said thermostatic control means further including connection means extending from said temperature sensing element along said tube passage and out through said opening to said tube passage so that said thermostatic control means can be connected to the heating unit exteriorly of said mounting assembly and the heater water tank.

2. A connection assembly for connecting an external heating unit to a heater water tank through a tank opening in the water tank so that water can be withdrawn from the wate tank, circulated through the heating unit for heating, and then returned to the water tank; said connection assembly comprising:

a mounting assembly connected to the tank opening and defining a first passage therein, said first passage having a first opening thereto interiorly of the water tank and a second opening thereto exteriorly of the water tank connected to the heating unit so that water can flow through said passage between the heater water tank and the heating unit;

a tube assembly mounted in said mounting assembly and extending through said first passage into the interior of the water tank, said tube assembly including a positioning tube having an inboard end and an outboard end, said positioning tube mounted in said mounting assembly and extending through said first passage so that the outboard end of said positioning tube is located exteriorly of said mounting assembly and the heater water tank and the inboard end of said positioning tube is located within the heater water tank, said positioning tube including an inboard section adjacent the inboard end thereof extending upwardly in the heater water tank so that the inboard end is located above the tank opening, said positioning tube defining a tube passage therein extending along the length thereof, said tube passage closed at the inboard end of said positioning tube to prevent water in the heater water tank entering the tube passage and opening through the outboard end of said positioning tube and said mounting assembly further including fitting means connecting said positioning tube to said mounting assembly, said fitting means constructed and arranged to selectively permit relative rotation between said positioning tube and said mounting assembly and to selectively rotationally fix said positioning tube with respect to said mounting assembly while sealing said positioning tube to said mounting assembly to prevent water leakage between said positioning tube and said mounting assembly; and thermostatic control means for controlling the operation of the heating unit, said thermostatic control means including a temperature sensing element mounted by said tube assembly within the water tank so that said temperature sensing element is exposed to the temperature of the water in the heater water tank, said thermostatic control means responsive to the temperature of the water in the heater water tank at said temperature sensing element being below a first prescribed temperature to operate the heating unit until the temperature of the water in the heater water tank at said temperature sensing element has been raised to a second prescribed temperature, said thermostatic control means including a switch mechanism and a capillary tube connecting said temperature sensing element to said switch mechanism to operate said switch mechanism in response to the temperature sensed by said temperature sensing element, said switch mechanism located exteriorly of said mounting assembly and the heater water tank and adapted to be connected to said heating unit to control the operation thereof, said temperature sensing element positioned in said tube passage adjacent the inboard end of said positioning tube so that said temperature sensing element is exposed through the positioning tube to the temperature of the water in the heater water tank about the inboard end of said positioning tube, and said capillary tube extending from said temperature sensing element along said tube passage and out the outboard end of said positioning tube to said switch mechanism.

3. A connection assembly for connecting an external heating unit to a heater water tank through a tank opening in the water tank so that water can be withdrawn from the water tank, circulated through the heating unit for heating, and then returned to the water tank; said connection assembly comprising:

a mounting assembly connected to the tank opening and defining a first passage therein, said first passage having a first opening thereto interiorly of the water tank and a second opening thereto exteriorly of the water tank connected to the heating unit so that water can flow through said passage between the heater water tank and the heating unit;

a tube assembly mounted in said mounting assembly and extending through said first passage into the interior of the water tank, said tube assembly defining a tube passage therein having a first tube opening thereto exteriorly of the heater water tank connected to the heating unit and a second tube opening thereto interiorly of the heater water tank so that water can be withdrawn from the heater water tank through one of said passages to be supplied to the heated unit for heating and the heated water returned from the heating unit to the heater water tank through the other of said passages; and thermostatic control means for controlling the operation of the heating unit, said thermostatic control means including a temperature sensing element mounted by said tube assembly within the water tank so that said temperature sensing element is exposed to the temperature of the water in the heater water tank, said thermostatic control means responsive to the temperature of the water in the heater water tank at said temperature sensing element being below a first prescribed temperature to operate the heating unit until the temperature of the water in the heater water tank at said temperature sensing element has been raised to a second prescribed temperature.

4. The connection assembly of claim 3 wherein said tube assembly has an inboard end within the water tank, said tube passage opening onto said inboard end; wherein said temperature sensing element is positioned in said tube passage at said inboard end and connected to said tube assembly so that said temperature sensing element blocks said tube passage; and wherein said second tube opening is defined through said tube assembly between said temperature sensing element and said mounting assembly.

5. The connection assembly of claim 3 wherein said thermostatic control means further includes connection means extending from said temperature sensing element along said tube passage and exits said tube passage through said tube assembly exteriorly of said mounting assembly and the water tank.

6. The connection assembly of claim 5 wherein said tube assembly includes a return tube extending through said mounting assembly and defining said tube passage therethrough, wherein said temperature sensing element is mounted on the outside of said return tube between said second opening to said tube passage and said mounting assembly and wherein said connection means extends into said tube passage at said temperature sensing element, along said tube passage, and exits said tube passage exteriorly of said mounting assembly and the heater water tank.

7. The connection assembly of claim 6 wherein said tube assembly further includes a mounting tube attached to the outside of said return tube and mounting said temperature sensing element therein, said mounting tube and said return tube having a combined maximum transverse cross-sectional dimension smaller than the size of the opening in the water tank in which said mounting assembly is connected.

8. The connection assembly of claim 7 wherein said return tube defines a longitudinally extending concave section therein sized to conform to said mounting tube and wherein said mounting tube is positioned in said concave section to minimize the combined maximum cross-sectional size of said return and mounting tubes.

9. The connection assembly of claim 3 wherein said tube assembly has an inboard end within the water tank; wherein said temperature sensing element is mounted adjacent the inboard end of said tube assembly; and wherein said second tube opening is located between said temperature sensing element and said mounting assembly.

10. The connection assembly of claim 9 wherein said thermostatic controller includes a switch mechanism and a capillary tube connecting said temperature sensing element and said switch mechanism, said switch mechanism located exteriorly of said mounting assembly and the water tank and said capillary tube extending from said temperature sensing element along said tube passage and exiting said tube passage through said tube assembly exteriorly of said mounting assembly and the water tank.

11. The connection assembly of claim 3 wherein said second tube opening is constructed and arranged to direct water flowing from said tube passage into the water tank away from said temperature sensing element.

12. The connection assembly of claim 3 wherein said mounting assembly includes fitting means connecting said tube assembly to said mounting assembly, sait fitting means constructed and arranged to selectively permit relative rotation between said tube assembly and said mounting assembly and to selectively rotationally fix said tube assembly with respect to said mounting assembly.

13. A method of heating water in a heater water tank with an external heating unit comprising the steps of:

withdrawing water from the heater water tank through the drain opening in the heater water tank;

passing the water withdrawn from the heater water tank through the external heating unit to heat the water;

locating the temperature sensing element of a thermostatic controller within the heater water tank at a location spaced from the location at which the heated water is returned to the heater water tank by mounting the temperature sensing element on a tube extending into the heater water tank through the drain opening so that water can be withdrawn from the heater water tank through the drain opening around the tube;

returning the heated water to the heater water tank by passing the heated water into the heater water tank through the passage in the tube mounting the temperature sensing element and discharging the heated water from the tube passage into the heater water tank at a location spaced from the temperature sensing element to allow the heated water to mix with the water in the heater water tank before its temperature is exposed to the temperature sensing element;

sensing temperature of the water in the heater water tank at the temperature sensing element; and controlling the operation of the heating unit in response to the temperature sensed by the temperature sensing element so that the heating unit is operated when the sensed temperature drops below a prescribed tank temperature until the temperature of the water at the temperature sensing element has been raised to the prescribed tank temperature.

14. The method of claim 13 wherein the step of passing the water through the heating unit includes passing the water through the heating unit at a rate such that the temperature of the water is raised about 5°–15° F. during passage through the external heating unit.

15. A method of heating water in a heater water tank with an external heating unit comprising the steps of:

withdrawing water from the heater water tank through the drain opening in the heater water tank;

passing the water withdrawn from the heater water tank through the external heating unit to heat the water;

returning the heated water to the water tank;

locating the temperature sensing element of a thermostatic controller within the heater water tank at a location spaced from the location at which the heated water is returned to the heater water tank by mounting the temperature sensing element on a tube extending into the heater water tank through the drain opening so that water can be withdrawn from the heater water tank through the drain opening around the tube and mounting the switch mechanism of the thermostatic controller on the tube mounting the temperature sensing element at a position exteriorly of the heater water tank and extending the capillary tube connecting the temperature sensing element and the switch mechanism through the passage in the tube;

sensing temperature of the water in the heater water tank at the temperature sensing element; and controlling the operation of the heating unit in response to the temperature sensed by the temperature sensing element so that the heating unit is operated when the sensed temperature drops below a prescribed tank temperature until the temperature of the water at the temperature sensing element has been raised to the prescribed tank temperature.

* * * * *